United States Patent [19]

Swilley

[11] Patent Number: 4,646,646

[45] Date of Patent: Mar. 3, 1987

[54] OVERHEAD TROLLEY TRACK SWITCH

[75] Inventor: Wilson H. Swilley, Persia, Iowa

[73] Assignee: The Cincinnati Butchers' Supply Company, Cincinnati, Ohio

[21] Appl. No.: 875,530

[22] Filed: Jun. 20, 1986

Related U.S. Application Data

[63] Continuation of Ser. No. 635,414, Jul. 30, 1984, abandoned.

[51] Int. Cl.[4] ..... E01B 25/26

[52] U.S. Cl. ..... 104/100; 104/130

[58] Field of Search ..... 104/93, 96, 100, 103, 104/110, 130; 74/501 R, 501 A, 501 B, 501 C, 501 D, 501 E, 501 M; 193/39

[56] References Cited

U.S. PATENT DOCUMENTS

| | | | |
|---|---|---|---|
| 822,121 | 5/1906 | Harris | 104/100 |
| 2,535,541 | 12/1950 | Le Fiell | 104/101 |
| 2,725,017 | 11/1955 | Bedford et al. | 104/104 |
| 2,746,397 | 5/1956 | Le Fiell | 104/101 |
| 2,944,491 | 7/1960 | Le Fiell | 104/100 X |
| 3,006,287 | 10/1961 | Schmidt, Jr. | 104/100 |
| 3,063,384 | 11/1962 | Sackett, Jr. | 104/130 X |
| 3,366,076 | 1/1968 | Ristow | 104/101 |
| 3,538,853 | 11/1970 | Dehne | 104/130 X |
| 3,739,727 | 6/1973 | Bedford | 104/130 X |
| 3,818,836 | 6/1974 | Swilley | 104/100 |
| 4,453,469 | 6/1984 | Bedford | 104/100 |
| 4,457,235 | 7/1984 | Fottner | 104/104 |

FOREIGN PATENT DOCUMENTS 1713 of 1901 United Kingdom .

*Primary Examiner*—Robert B. Reeves
*Assistant Examiner*—David F. Hubbuch
*Attorney, Agent, or Firm*—Lee, Smith & Zickert

[57] ABSTRACT

A switch for controlling the movement of trolleys on overhead tracks, which comprises a plurality of tracks intersecting with each other, wherein the switch is adaptable to be inserted between intersecting tracks and adjustable for handling trolley movement from one track to another. The switch is adaptable to be inserted between straight and curved tracks, curved and curved tracks, and to automatically handle the movement of the trolleys in one direction, and includes a unique cable transmission system for controlling trolley movement which provides positive movement of said lift pieces without relying on gravitational forces, thereby avoiding malfunctions.

18 Claims, 17 Drawing Figures

OVERHEAD TROLLEY TRACK SWITCH

This is a continuation of Ser. No. 635,414 filed July 30, 1984, now abandoned.

DESCRIPTION

This invention relates in general to a switch for an overhead trolley track, and more particularly to a switch for insertion between overhead track sections for controlling the movement of trolleys between the sections, and still more particularly to a switch having an improved mechanism for enhancing the movement of the trolleys between track sections.

BACKGROUND OF THE INVENTION

Heretofore, it has been well known to provide switches for overhead track systems along which trolleys are either manually or power driven and particularly for the movement of goods suspended from the track by the trolleys between stations for processing or storing the goods. For example, overhead conveyors having tracks and switches in the trcks are commonly used in warehouse operations and also in meat-processing plants. Exemplary of the type of mechanisms heretofore known are disclosed in U.S. Pat. Nos. 2,746,397 and 3,818,836. These switches include a plurality of levers and links arranged between lifting track sections, the position of which control the movement of trolleys along intersecting tracks or rails. It is also known, as shown in these patents, to automatically allow the movement of a trolley through the switch in one direction without manually or otherwise adjusting the switch. Movement in the opposite direction is controlled by adjustment of the switch.

The heretofore known switches have been bulky in structure, thereby requiring considerable room in layouts for their installation. They have also been constructed of a large number of parts which cause adjustment and maintenance difficulties and costs.

SUMMARY OF THE INVENTION

The present invention overcomes the problems heretofore known and provides a switch for overhead track systems that is more compact and therefore more adaptable and versatile in track layouts. Additionally, the switch of the present invention has a lesser number of parts than heretofore known, thereby providing easier and less costly maintenance and adjustment procedures.

More particularly, the switch of the present invention generally reduces the mechanical parts by uniquely providing a force transmission system between the rail lifting sections of the switch. The transmission system of the present invention includes a sheathed cable extending between the lifting rail sections and mounted in such a way that it can be easily adjusted to provide the proper operational movement between the rail sections.

It is an object of the present invention to provide a new and improved switch for overhead trolley track systems that is more compact and therefore more adaptable and versatile in track layouts.

Another object of the present invention is to provide a new and improved switch for an overhead track system that is more simply constructed and includes a relatively small number of parts which ultimately provide easier and less costly maintenance and enables the switch to be more easily and less costly adjusted in a system.

Another object of the present invention is in the provision of a new and improved switch for an overhead track system which includes a unique force transmission system utilizing a sheathed cable for coordinating the movement between lifting track sections and the movement of trolleys through the switch.

Other objects, features and advantages of the invention will be apparent from the following detailed disclosure, taken in conjunction with the accompanying sheets of drawings, wherein like reference numerals refer to like parts.

DESCRIPTION OF THE PREFERRED EMBODIMENTS

The track switch of the present invention is primarily useful for overhead conveyor systems installed for the purpose of transporting and moving goods between stations or locations. Particularly, the conveyor serves to movably support trolleys along flat bar or round bar tracks or rails. The trolleys generally include a single wheel or roller supporting a bracket and suitable means for attaching thereto the goods to be moved along and within the track or conveyor system. The trolleys may be power driven or manually driven. A track layout may include one or more main tracks and any number of auxiliary tracks. Normally, work stations will be situated along the main tracks although they may likewise be situated along an auxiliary track. Storage areas may also be associated with auxiliary tracks. The track switch of the invention is intended to assist in controlling the movement of the trolleys between intersecting tracks. The intersecting tracks would be arranged to have the track switch positioned to allow movement of the trolleys therebetween in whatever desired direction. Normally, the intersecting tracks are at right angles to each other but they may also be angularly related to each other.

The track switch of the invention includes a combination of straight and curved sections or curved and curved sections. Where straight and curved sections are used, the curved section may come in from either side and either the straight or curved section may be considered to be the main track. Where curved and curved sections are provided, either of the curved sections may be considered the main track. Track lift pieces are provided for each of the track members in the switch and are selectively movable between a non-trolley engageable raised position and a trolly engageable seated position for purposes of allowing trolley movement through the track on one or the other of the track members. A transmission device is provided to control the position of the lift pieces such that only one lift piece is in trolley engageable seated position at any one time. Further, the transmission system permits automatic movement of a trolley through the switch from either of the track members in one direction whether or not the lift pieces of whichever member the trolley is movable along is in the trolley engageable or non-trolley engageable position. If a lift piece is in non-trolly engageable position, the trolley engages the lift piece and forces it into seated position and at the same time through the transmission system forces the other lift piece into non-engageable position.

It is the transmission system that is unique in the present invention in that it utilizes a cable drive between the lift pieces, thereby greatly simplifying the structure for controlling movement of the lift pieces and resulting in a more reliable and easily mountable switch.

Figure 1:
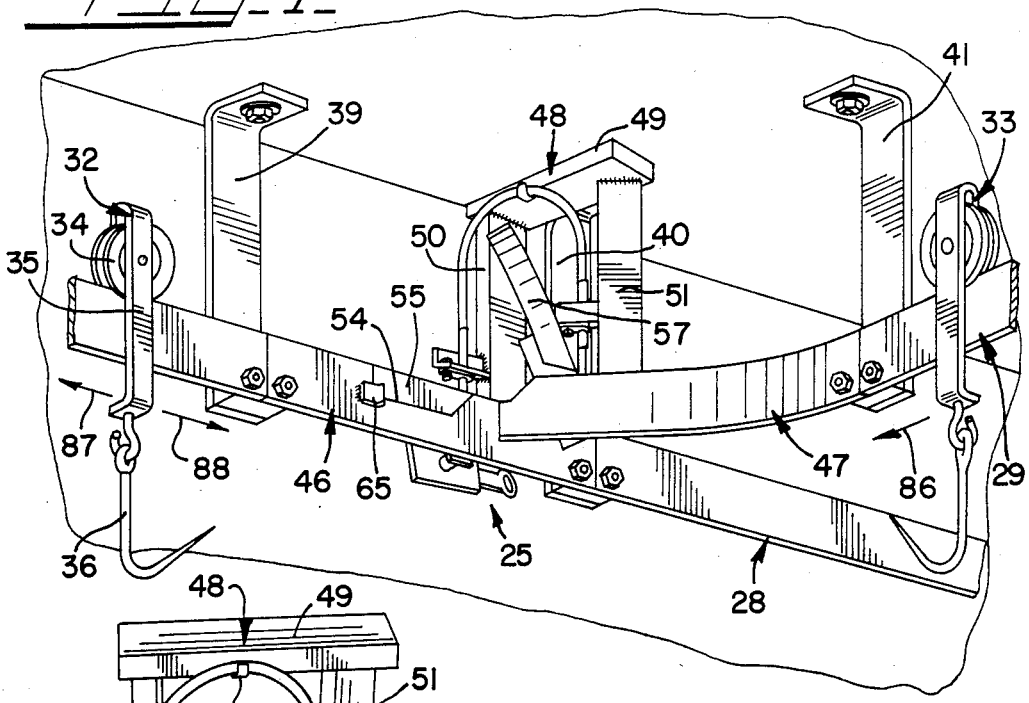
FIG. 1 is a perspective view looking from below of a switch according to the present invention installed in a track layout.
Figure 2:
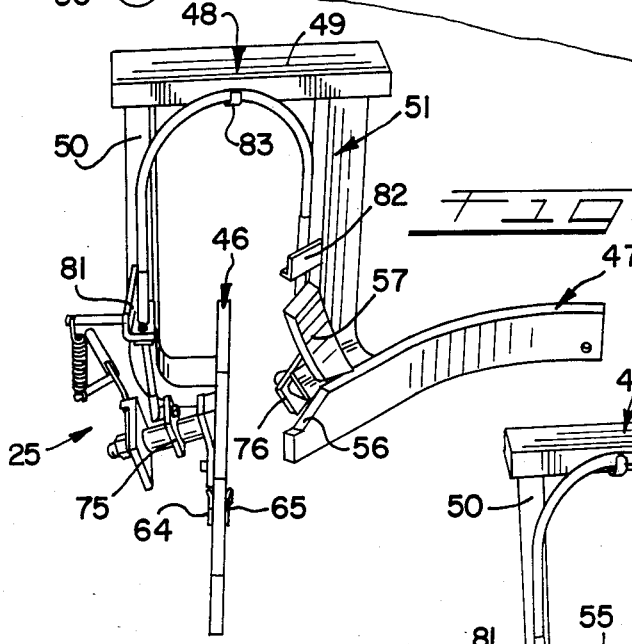
FIG. 2 is a perspective view of the switch of FIG. 1 removed from the track system and looking from above with the lift section or piece of the main track in down position and the lift section of the curved track in up position.
Figure 13:
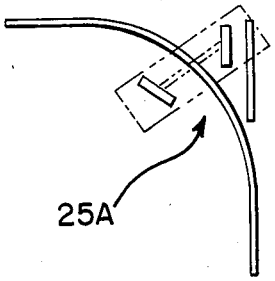
FIG. 13 is a schematic top plan view of a track switch according to the invention where the curved portion is situated at the opposite side from the embodiment shown in FIG. 1.

Referring now to the drawings, and particularly to the embodiment disclosed in FIGS. 1 to 10, the track switch 25 of the invention is illustrated in a form hereinafter referred to generally as a straight and curved unit and where the curved track member comes into the main track from the right as viewed from above in FIG. 2. It may be readily appreciated that the curved track member may come in from the left or opposite side where so desired or needed in a track layout, such as schematically illustrated in FIG. 13. The track switch is installable in an overhead track system suspended from the ceiling, as generally illustrated in FIG. 1, and situated between intersecting tracks. The switch is illustrated as being mounted between a main track or rail 28 and an auxiliary track or rail 29. The track is of the flat bar configuration, although it will be appreciated that the present invention may be utilized in track layouts having track of the round bar configuration, as illustrated particularly in FIGS. 16 and 17.

Movable along the tracks are trolleys of the usual type including a roller or wheel, and bracket means suspended from the wheel and for supporting a goods engaging member. As seen particularly in FIG. 1, trolleys 32 and 33 are illustrated with trolley 32 being situated on the main track 28, and trolley 33 suspended from the auxiliary track 29. For purposes of clarity, each trolley includes a grooved wheel or roller 34 oriented in upright position and engageable along the top edge of the track or rail, a bracket 35 extending downwardly from the wheel and having the wheel rotatably mounted thereto. The bracket terminates at a point below the track and is shown to have a meathook 36 secured thereto for engagement with a piece of meat being transported by the trolley. Other goods engaging devices may be mounted on the bracket depending upon the goods desired to be conveyed by the system.

For purposes of illustration, the main rail is shown to be supported from the ceiling by anchors 39 and 40, while the auxiliary rail 29 is illustrated as being supported from the ceiling by a hanger 41. These hangers likewise support the switch track 25, as will be explained below.

The track switch 25 includes generally a straight track member 46 and a curved track member 47 interconnected by a bridge 48 extending above the track members but being of a height to clear the ceiling. The bridge 48 includes an overhead crossbar 49, a downwardly extending leg 50 inwardly turned at its lower end and suitably connected to the straight track member 46, and a downwardly extending leg 51 with an inwardly extending portion at its lower end that is suitably connected to the curved track member 47. Thus, the bridge 48 supports and maintains the relationship between the straight and curved track members.

Figure 7:
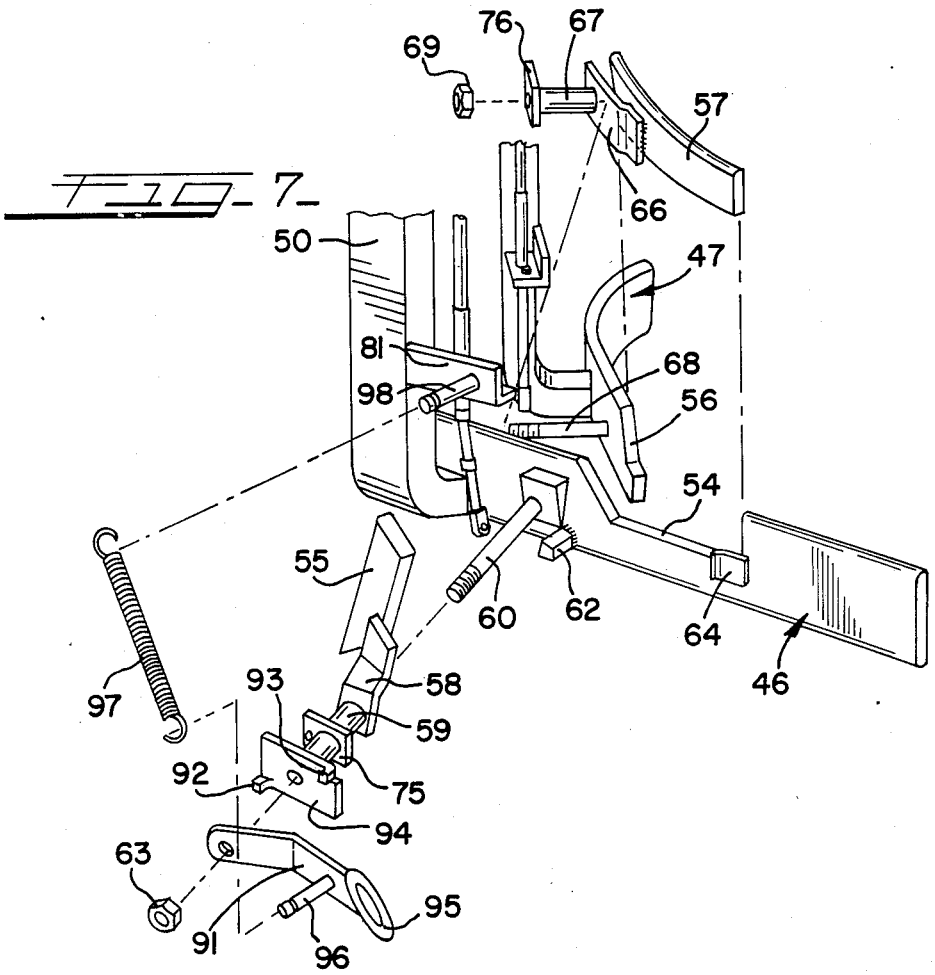
FIG. 7 is an exploded view of the track section with all parts removed from the track and bridge assembly.
Figure 8:
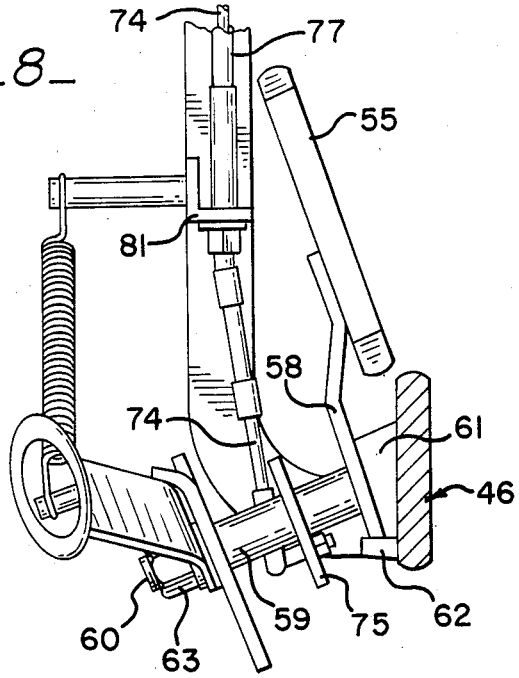
FIG. 8 is an elevational end view showing the straight track or rail in cross section and the angle of the shaft mounting the straight lift piece and with the lift piece in the up position.
Figure 9:
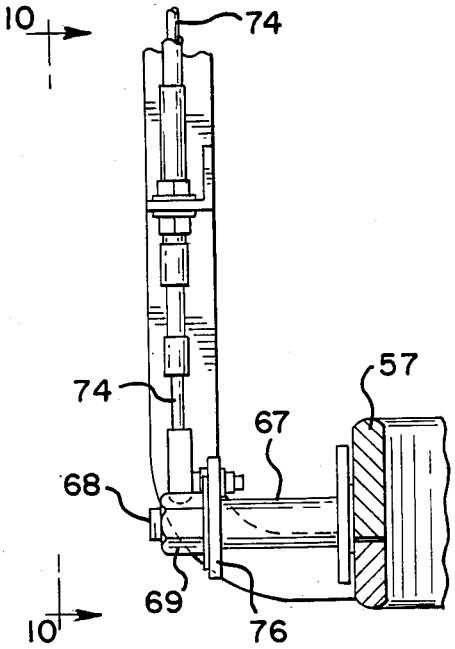
FIG. 9 is a detailed elevational view showing the rail shaft for the curved lift piece.
Figure 10:
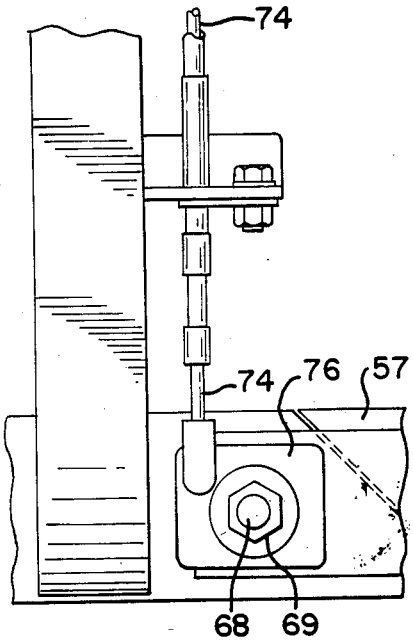
FIG. 10 is a side elevational view of the crank for the curved rail shaft.

The straight track member 46 includes a cut-out portion 54, as seen more clearly in FIG. 7, along its upper trolley engaging portion for selectively receiving in seated position therewith a straight lift piece 55 formed to mate with the cut-out portion. The curved track member 47 terminates short of the straight track member 46 to allow movement of a trolley thereby along the straight track member and is provided with a notch 56, as seen most clearly in FIG. 2, at its end adjacent the straight track member which mates with the inner end of a curved lift piece 57 when the lift piece is in seated position and forming a connection with the straight track member 46. The free end of the curved lift piece seats on straight track member at the forward end of the cutout 54.

The straight lift piece 55 is secured to an arm 58 that is in turn secured to a tubular hub member 59 situated at one side of the straight track member 46 and pivotally mounted on a shaft 60 supported on the straight track member. As seen particularly in FIGS. 7 and 8, the shaft 60 extends from a wedge-shaped block 61 that thereby orients the shaft at an angular position to the straight track member 46 so that the straight lift piece 55 moves upwardly and away from the straight track member 46 and the cut-out portion therein when it moves from seated position to raised position, thereby assuring that it clears movement of the curved lift piece when the latter moves into seated position. When in seated position, the arm 58 engages a stop 62. the tubular member is held in place on the shaft 60 by means of a nut 63. Guide members 64 and 65 are provided at the front end of the cutout 54 to guide movement of the lift piece 55 into properly aligned position with the track member 46. These guides also serve to assist in guiding the curved lift piece into seated position on the straight track member.

Figure 3:
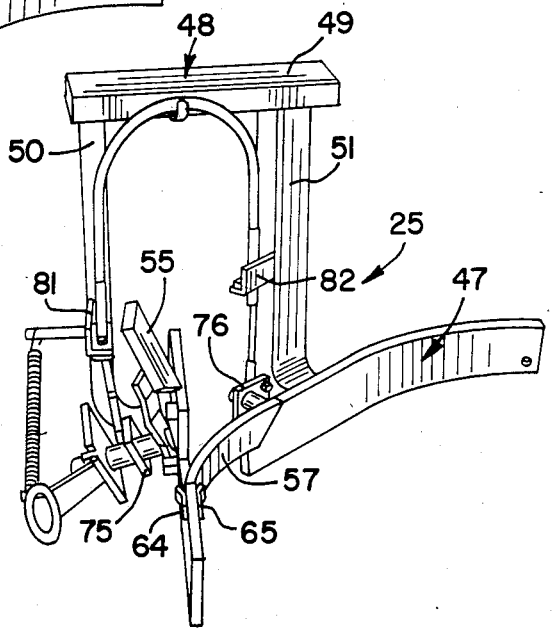
FIG. 3 is a view similar to FIG. 2 but with the lift section for the main track in up position and the lift section for the curved track in down and operating position.
Figure 4:
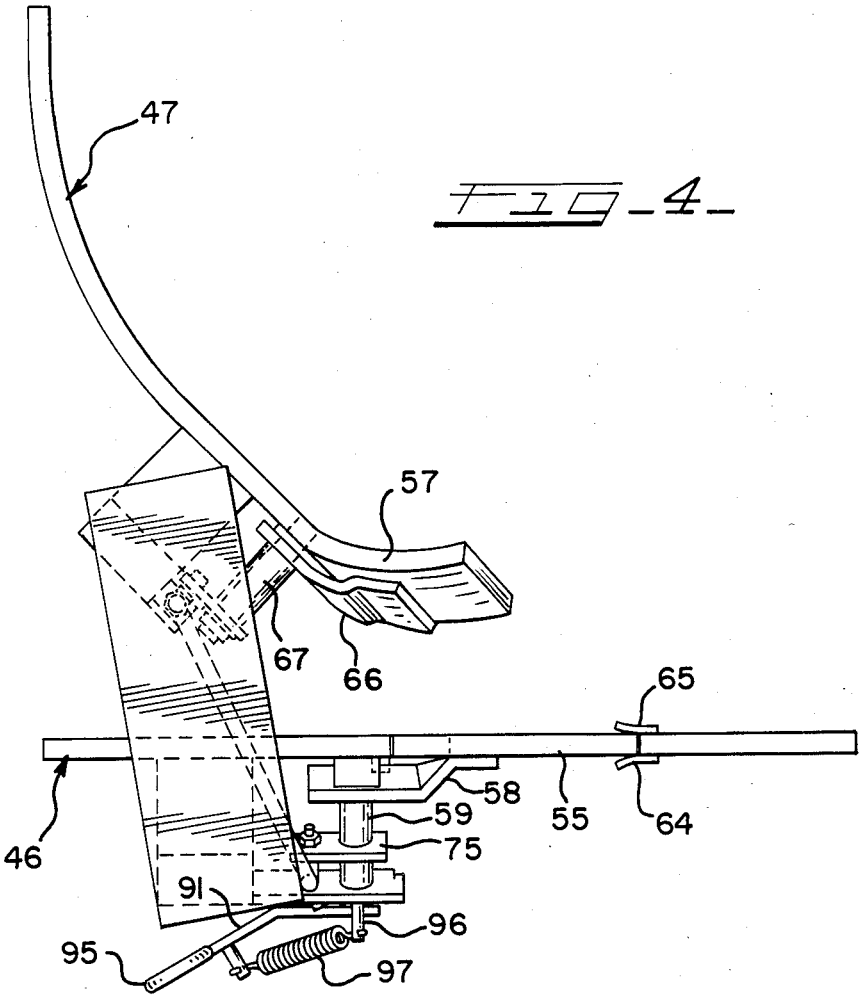
FIG. 4 is a top plan view of the switch of FIG. 1 with some parts in phantom and with the straight rail lift piece down and the curved rail lift piece up.

The curved lift piece 57 is secured to an actuating arm 66 that is in turn mounted on a tubular hub member 67 which is pivotally received on a shaft 68. The shaft 68 extends perpendicular to the curved track member 47 such that the curved lift piece moves straight up from the track member when it moves between the raised non-trolley engageable position and the lowered and seated trolley engageable position. A nut 69 secures the tubular member 67 in place on the shaft 68. The free end of the curved lift piece 57 is guided into position when it is lowered by the guide members 64 and 65. When in seated position, the curved lift piece 57 interconnects the curved track member 47 with the straight track member 46, as illustrated in FIG. 3.

The unique transmission system for controlling the intercoacting movement of the straight and curved lift pieces includes a cable drive having a cable 74 connected at one end to a crank arm or member 75 on the straight life piece tubular member 59 and at the other end to a crank arm or member 76 on the curved lift piece tubular member 67. The cable is slidably supported intermediate its ends within a sheath 77 which is secured at one end to a bracket 81 extending from the bridge leg 50 and at the other end on a bracket 82 extending from the bridge leg 51. Conventional adjusting means is provided for the sheath and cable assembly to enable quick and easy adjustments for assuring the desired movement between the lift pieces and the final desired raised or seated positions. Further, suitable interconnecting means are provided between the terminal ends of the cable and the cranks 75 and 76 for the straight and curved lift pieces respectively. The sheath and cable assembly therefor is supported by the brackets 81 and 82. Additionally, the upper loop end of the assembly is held in place on the bridge crossbar 49 by means of a suitable clip 83. The terminal ends of the cable are associated with the crank arms for the straight and curved lift pieces so that movement of one lift piece causes movement of the other lift piece in the opposite direction. For example, if the straight lift piece 55 is in its lower seated position and the curved lift piece 57 is in its upper raised position, as shown particularly in FIGS. 1 and 2, a force against the curved lift piece 57 toward its seated position will automatically cause through the cable transmission system a force to be applied to the straight lift piece to bring it to its upper raised position so that when the curved lift piece is in seated position the straight lift piece 55 will be in its upper raised position, as shown in FIG. 3. In this connection the particular mounting of the cables to the crank arms can be seen in FIGS. 9 and 10 for the curved lift piece 57 and in FIGS. 4 and 5 for the straight lift piece 55.

The embodiment of FIGS. 1 to 10 also includes a selector mechanism that may be referred to as a shift lever means for selectively positioning either the straight lift piece or the curved lift piece in normally seated position. If the straight lift piece is selectively normally positioned in seated trolley engageable position, the curved lift piece is then in its raised trolley nonengageable position. Yet, as already mentioned, should a trolley such as trolley 33 in FIG. 1 be then manually or power driven in the direction of the arrow 86, it would engage the curved lift piece 57 and force it into its seated position so that the trolley could continue to move onto the straight track member 46 and the main track 28, while at the same time causing the straight lift piece 55 to move upwardly and out of the way so that movement of the curved lift piece can move into seated position. Similarly, whether or not the straight lift piece is in down position, if a trolley is moving along the main track 28 in the direction of arrow 87 for trolley 32, it can move through the track switch. Should the straight lift piece be in the upper position, the trolley would engage the lift piece and force it in its downward position and at the same time force the curved lift piece into its up position. Should there be a reason to move the trolley 32 in the direction of arrow 88 and have it move along the main track 28, it will be necessary to have the straight lift piece in its down and seated position, as shown in FIG. 1, or if the trolley is to move to auxiliary track 29, it would then be necessary to have the curved lift piece 57 in its down and seated position. Movement of trolleys in the direction of arrow 88 will not cause automatic operation of the lift pieces as will movement of the trolleys in the direction of arrows 86 and 87.

Figure 5:
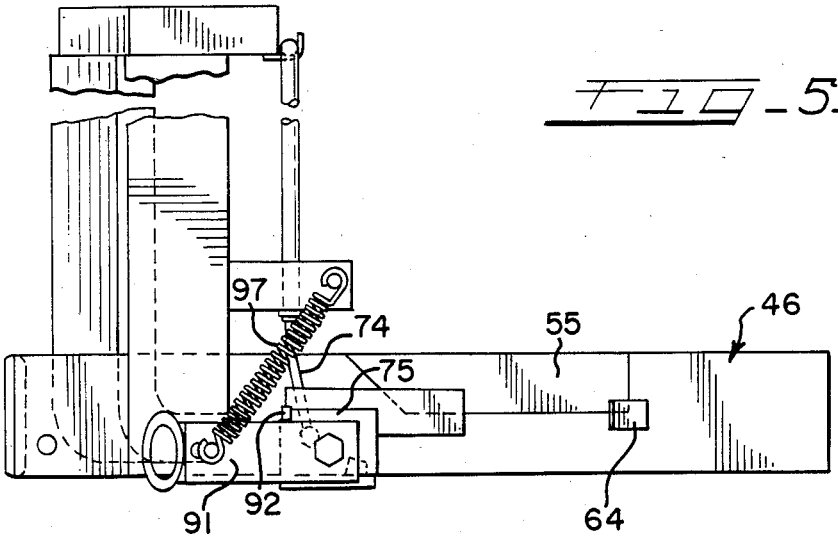
FIG. 5 is a side elevational view of the switch in FIG. 4.
Figure 6:
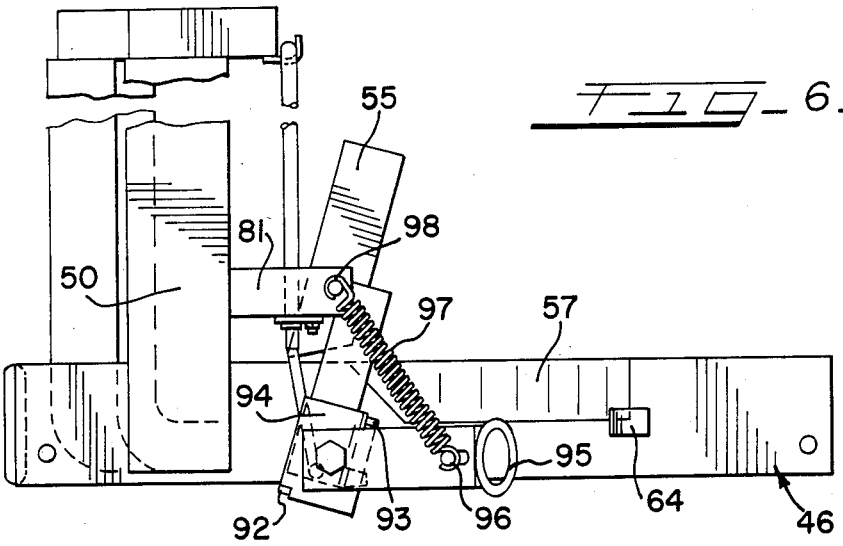
FIG. 6 is a view like FIG. 5 which is partially fragmentary and which shows the straight lift piece in the up position and the curved lift piece in the down position.

The selector mechanism includes a shift lever 91 that is pivotally carried on the straight lift piece shaft 60 and engageable with tabs 92 and 93 on shift lever plate 94. The outer end of the shift lever 91 includes a hand-engageable or mechanically engageable portion 95, and also in spaced relation from its pivotal end is a pin 96 having one end of a spring 97 connected thereto, while the other end of the spring is connected to a pin 98 that is fixed to the cable supporting bracket 81 on bridge arm 50. The shift lever 91 moves selectively overcenter with respect to the alignment of the spring supporting pins 96 and 98 and the shaft 60 to either engage the tab 93, as shown in FIG. 6, to cause the straight lift piece 55 to be normally positioned in its upper non-trolley engageable position, while the curved lift piece 57 is in its lowered and seated position. When the lift lever 91 is shifted to its opposite position, it then engages the tab 92, as shown in FIG. 5, to cause the straight lift piece 55 to be in its lower seated position. Thus, the shift lever 91 will be disposed in an overcenter toggle relation either for normally having the straight lift piece in seated position or the curved lift piece in seated position. It may now further be appreciated that the spring 97 functions to hold the lift pieces in whichever position selected and also functions to return the lift pieces to the selected position if forced from a normal raised position to a seated position by a moving trolley once the trolley has completed its travel over the lift piece. It may be further appreciated that a counterweight could be mounted on the shift lever 91 in place of using a spring for producing the position and return functions.

By virtue of the unique transmission system for effecting movement between the straight and curved lift pieces, the switch track of the invention may be easily adjusted in the field when it is being installed to obtain proper movement between the lift pieces and proper seated positioning. Additionally, should the cable wear out and need replacement, it may be easily and quickly replaced without returning the track switch to the manufacturer. Because of the use of the cable transmission system, the track switch is more compact since it does not require the room heretofore required by the rather complex link and lever systems. Referring to FIG. 1, it will be readily appreciated that the opposite ends of the straight track member 46 are provided with bolt holes, while the outside end of the curved track member 47 is provided with mounting the track section on the hangers 39, 40 and 41, as shown.

Figure 11:
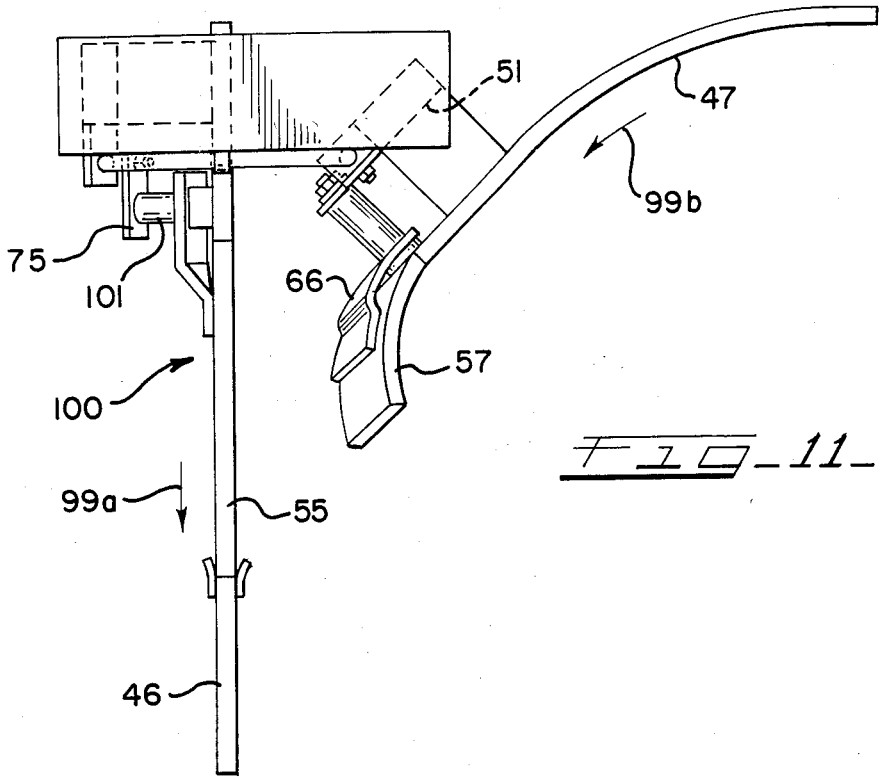
FIG. 11 is a top view of a modified track switch according to the invention and particularly one which is defined as a feed-out switch.
Figure 12:
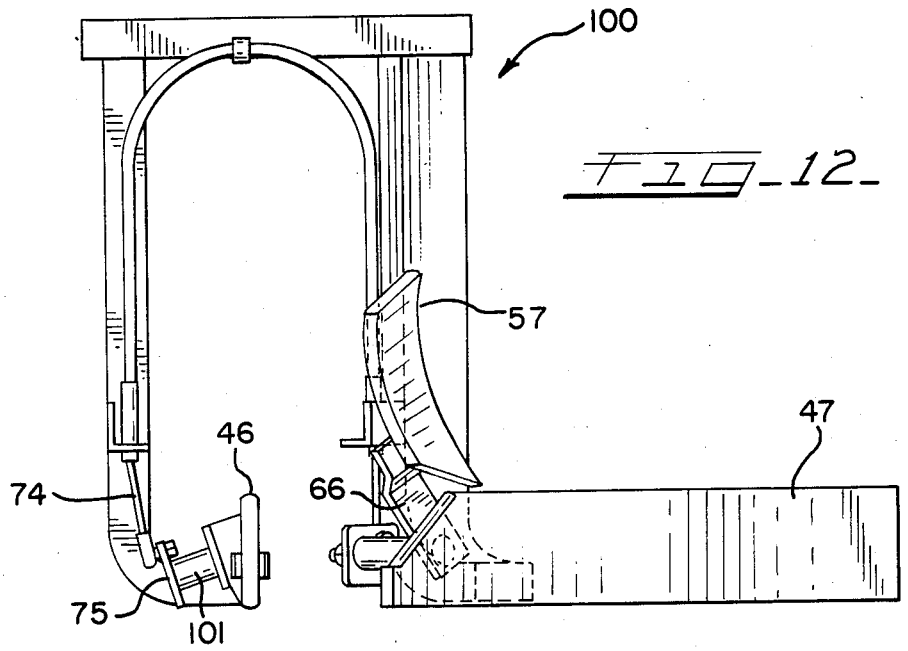
FIG. 12 is a front elevational view of the feed-out switch of FIG. 11.

The cable transmission system of the present invention is also applicable to track switches other than that disclosed in FIGS. 1 to 10, such as the feed-out switch illustrated in FIGS. 11 and 12, which differs only in that the shift lever mechanism is omitted. The feed-out switch is useful for moving trolleys from a storage track onto a main track but is operable only in one direction as noted by arrows. Accordingly, it includes many of the same elements as shown in the embodiment of FIGS. 1 to 10 and which will be identified by the same legends for purposes of simplicity and clarity. The feed-out track switch is generally designated by the numeral 100. The straight lift piece shaft is shorter as is the tubular member 101 mounted thereon since it only needs to have the crank arm 75 for connection to the cable 74. One of the lift pieces is normally in seated position, while the other is in raised position depending upon the last movement of a trolley along the straight track member or the curved track member. Movement of a trolley along one of the track members causes movement downwardly into seated position of that respective lift piece and simultaneous raising of the other lift piece. Once the trolly has cleared a lift piece, it remains in that position until the other lift piece is depressed by a trolley moving thereover which causes the reversal of positions of the lift pieces.

Figure 14:
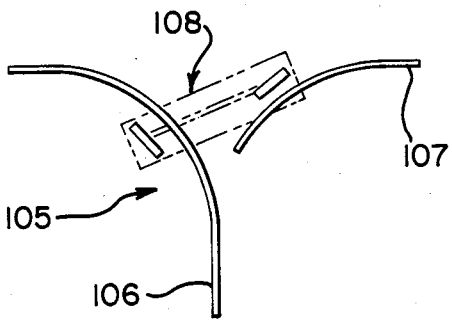
FIG. 14 is a top plan schematic view of a switch according to the present invention which includes two curved sections coming into a main track.

As already mentioned, the embodiment of FIG. 1 is suitable where the auxiliary track is on the right side of the main track. The invention is equally applicable to an embodiment where an auxiliary track may be on the left side, as illustrated by the schematic track switch 25A in FIG. 13. Similarly, the transmission system of the invention can be applied to a track switch where the main track has a curved corner, as illustrated in the schematic track switch 105 shown in FIG. 14. In this embodiment, the track switch would include two intersecting curved track members with two curved lift pieces wherein the main track is designated 106 and the auxiliary track 107 coming from the right side. A cable transmission system 108 would control the movements of the lift pieces for each of these tracks.

Figure 15:
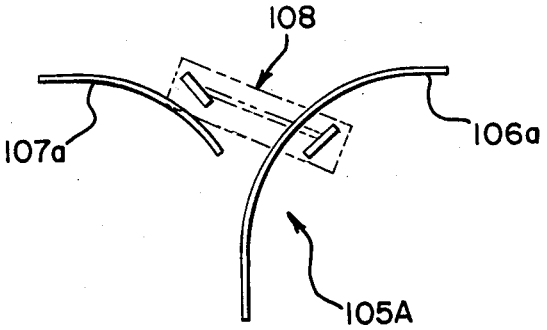
FIG. 15 is a top plan view of a further modification of the present invention which is like FIG. 14 except that one curved section comes in from the other side.

It may be further appreciated that the transmission system of the invention could be used for intersecting tracks where the switch track would have two curved track members and the auxiliary track would come in from the left side, as illustrated by the embodiment 105A in FIG. 15. This would merely be the opposite of the embodiment of FIG. 14.

Figure 16:
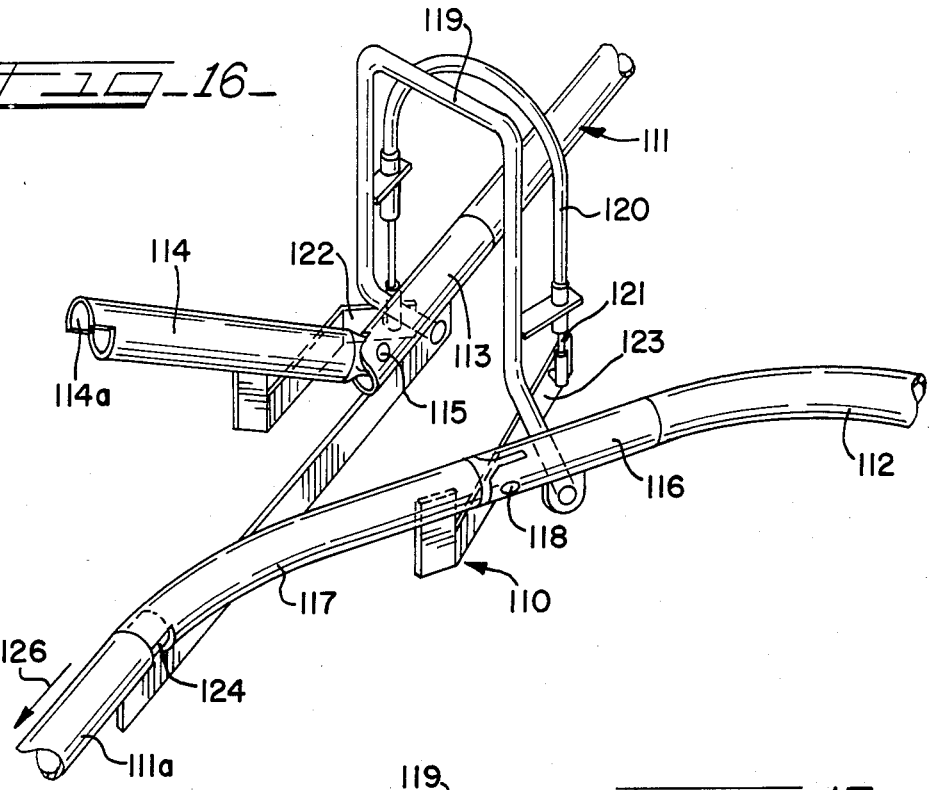
FIG. 16 is a perspective view looking from above of the switch according to the invention installed in a track system and which utilizes round rail in place of the bar-shaped rail of the embodiment of FIG. 1 and showing the straight lift piece in the up position and the curved lift piece in the down position.
Figure 17:
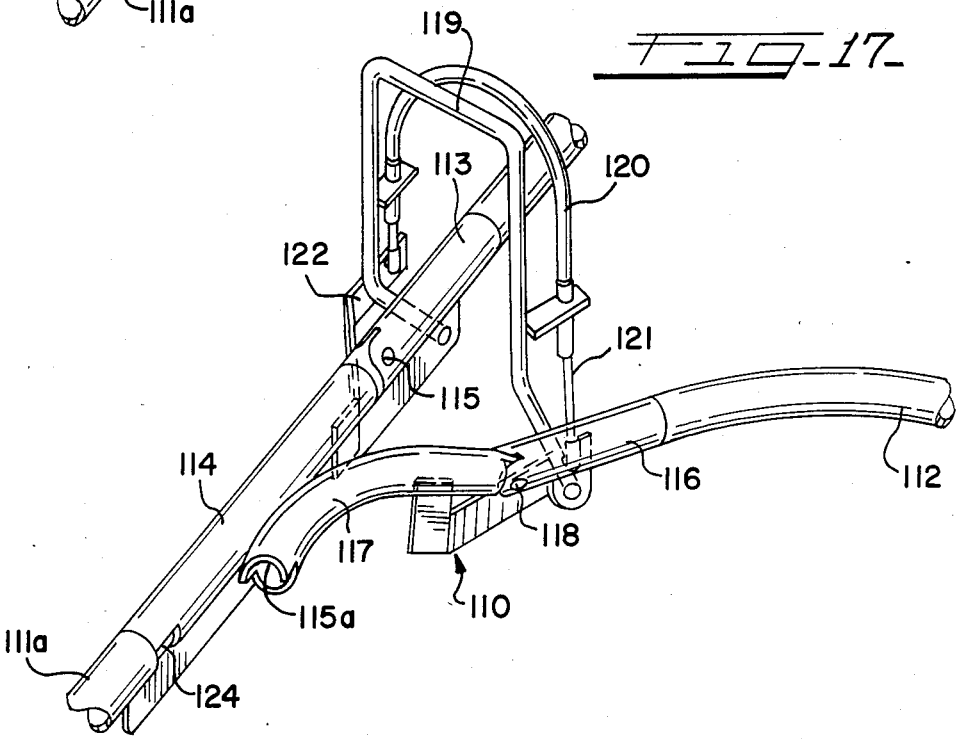
FIG. 17 is a view similar to FIG. 16 but showing the straight lift piece in the down position and the curved lift piece in the up position.

The cable transmission system of the present invention can likewise be applied to a round bar track system, as illustrated in FIGS. 16 and 17, wherein the switch track is generally designated by the numeral 110 and is installed between a main track 111 and an auxiliary track 112. The track switch 110 would therefore selectively allow trolley travel along the main track 111 or between the main track and the auxiliary track 112.

The round bar track switch includes a straight track member 113 having a straight lift piece 114 pivotally carried at 115, a curved track member 116 and a curved lift piece 117 pivotally connected to the curved track member 116 at 118. A bridge assembly 119 interconnects the straight and curved track members and supports a sheathed cable assembly 120 having a cable 121 connected at one end to an actuating arm 122 of the straight lift piece 114 and at the other end to an actuating arm 123 of the curved lift piece 117. The respective free ends of the straight and curved lift pieces are channel-shaped at **114*a* and 115*a* and when in seated position engage a pin 124 extending from the forward portion 111*a* of the main track 111. This version is a switch that will serve to handle trolley movement in the direction of the arrow 126 where the trolleys move along the main track 111 or the auxiliary track 112 and through the track switch. This switch is illustrated as a feed-out type like that shown in FIGS. 11 and 12. Thus, it would operate in the same manner. Moreover, it should be recognized that a shift lever mechanism of the type shown in the embodiment of FIGS. 1 to 10 could be employed for purposes of selectively maintaining either of the lift pieces in seated position. Otherwise, the operation of the track switch and the movement of the lift pieces would be the same as previously described in connection with the flat bar track switch versions herein illustrated. The cable 121 serves as the interconnecting transmission system between the movable lift pieces 114 and 117**.

It is therefore appreciated that the track switch of the present invention with its unique cable transmission system is substantially superior to the switches heretofore known. Further, it may be easily serviced in the field to provide proper operation.

It will be understood that modifications and variations may be effected without departing from the scope of the novel concepts of the present invention, but it is understood that this application is to be limited only by the scope of the appended claims.

The invention is hereby claimed as follows:

1. In combination with an overhead trolley track system having a plurality of tracks movably supporting a plurality of trolleys, a switch for a pair of intersecting tracks for controlling trolley movement between the tracks which comprises, first and second track members, bridge means for interconnecting and supporting said track members in juxtaposed spaced relation, a track lift piece for each said track member, said lift pieces being mounted to be alternately movable between a first non-trolley engageable raised position and a second trolley engageable seated position to allow trolley movement through the switch on the track member having the lift piece in seated position, shaft means extending from each of the track members, a hub member pivotally supported on each said shaft means, said lift pieces being connected to and supported by said hub members, crank arms on the hub members, and a cable transmission assembly connected between the crank arms such that upon seating of one lift piece in its operable trolley engageable position the other lift piece moves to its non-trolley engageable position.

2. The switch as defined in claim 1, which further includes a shift lever means coupled to one of said lift pieces for selectively positioning one or the other of the lift pieces into seated trolley engageable position and the other in trolley non-engageable position and causing the lift pieces to return to the set positions after actuated to the opposite positions by a trolley moving through the switch.

3. The switch as defined in claim 1, wherein one of said track members is straight and the other of said track members is curved.

4. The switch as defined in claim 3, wherein said shaft means for said straight track member is disposed on the side opposite to the curved track member and inclined downwardly so that the lift piece mounted thereon when moving to the raised position will move through a path directed upwardly and outwardly from the curved track member, and said shaft means for said curved track member is disposed horizontally so that the lift piece thereof moves through a vertical plane between its first and second positions.

5. The switch as defined in claim 1, wherein both of said track members are curved.

6. In combination with an overhead trolley track system having a plurality of tracks movably supporting a plurality of trolleys, a switch for a pair of intersecting tracks for controlling trolley movement between the tracks which comprises, first and second track members connected to said tracks, bridge means for interconnecting and supporting said track members in juxtaposed spaced relation, a track lift piece for each said track member, said lift pieces being pivotally mounted to the track members and movable between a first non-trolley engageable raised position and a second trolley engageable seated position to allow trolley movement through the switch on the track member having the lift piece in seated position, and a cable drive interconnected between said lift pieces such as to cause positive and simultaneous movement of said lift pieces between said first and second positions without relying on gravitational forces, wherein movement of one lift piece to a non-trolley engageable raised position causes movement of the other lift piece to a trolley-engageable seated position, said cable drive including a sheath connected at opposite ends to said interconnecting and supporting means and a cable slideably received in said sheath and connected at one end to one of said lift pieces and the other end to the other of said lift pieces.

7. The switch defined in claim 6, which further includes a shift lever means coupled to one of said lift pieces for selectively positioning one of said lift pieces in seated position while allowing movement along both track members in one direction.

8. The switch defined in claim 7, wherein said shift lever means includes means for returning the lift piece selected for seated position back to seated position if raised by a trolley moving through the switch of the other track member and causing movement of said lift pieces.

9. The switch defined in claim 8, wherein said return means includes a spring.

10. The switch defined in claim 8, wherein one of said track members is straight and the other of said track members is curved.

11. The switch defined in claim 8, wherein both of said track members are curved.

12. A switching unit for overhead tracks having trolleys movable therealong comprising, a first track member and a second track member in intersecting relation with the first track member, one of the track members having an upper section cut away to form a recess, the other track member having its free end in spaced relation from the said one track member, a switching element for each of said track members and being pivotally mounted thereto for movement into position to allow trolley movement along a track member, and cable means directly interconnected between the switching elements to positively and simultaneously drive the switching elements alternately between working and non-working positions without relying on gravitational forces.

13. A switching unit as defined by claim 12, which further includes control means for selectively positioning one of the switching elements into working position and causing return of same to working position if driven into non-working position by the other switching element.

14. A switch for intersecting tracks having trolleys movable thereon which comprises, first and second track members, means for interconnecting and supporting said track members in juxtaposed spaced relation, a track lift piece for each said track member, said lift pieces being mounted to be alternately movable between a first non-trolley engageable raised position and a second trolley engageable seated position to allow trolley movement through the switch on the track member having the lift piece in seated position, and cable means directly interconnected between said lift pieces to positively and simultaneously drive each lift piece between said raised and seated positons without relying on gravitational forces and permit only one of said lift pieces to be in seated position at any one time.

15. A switch as defined in claim 14, which further includes control means for selectively positioning one of said lift pieces in seated position and causing said one lift piece to return to seated position if driven into raised position by a trolley moving through the switch and depressing the other of said lift pieces.

16. A switch as defined in claim 14, said cable means including a sheath mounted at its ends to said interconnecting means, and a cable slidably received in said sheath and connected at opposite ends to said lift pieces.

17. A switch as defined in claim 16, which further includes a shift lever means coupled to one of said lift pieces for selectively positioning one of said lift pieces in seated position while allowing movement along both track members in one direction.

18. A switch as defined in claim 17, wherein said shift lever means includes means for returning the lift piece selected for seated position back to seated position if raised by a trolley moving through the switch of the other track member and causing movement of said lift pieces.

* * * * *